United States Patent [19]

Vanderjagt

[11] Patent Number: 4,570,833

[45] Date of Patent: Feb. 18, 1986

[54] PUMPING SYSTEM

[76] Inventor: John A. Vanderjagt, 1395 Glen Oaks, Memphis, Tenn. 38117

[21] Appl. No.: 526,906

[22] Filed: Aug. 26, 1983

[51] Int. Cl.[4] ..... B65D 88/54

[52] U.S. Cl. ..... 222/333; 222/382; 222/385; 417/269

[58] Field of Search ..... 222/385, 383, 382, 380, 222/333, 372, 464; 417/269, 271; 74/60

[56] References Cited

U.S. PATENT DOCUMENTS 3,055,304 9/1962 Ziegler ..... 222/385 X 3,227,326 1/1966 Beamer ..... 222/333 X 4,245,760 1/1981 Stevenson et al. ..... 222/464 X 4,396,357 8/1983 Hartley ..... 417/269

*Primary Examiner*—Joseph J. Rolla

*Assistant Examiner*—David H. Bollinger

*Attorney, Agent, or Firm*—Walker & McKenzie

[57] ABSTRACT

A closed pumping system for containing and dispensing liquids such as liquid chemicals and the like. The system has a pump that is an integral part of the container and a driving mechanism for the pump which is detachable from the pump to be used again with subsequent containers. The container with the pump thereon may be disposed of.

11 Claims, 37 Drawing Figures

PUMPING SYSTEM

BACKGROUND OF THE INVENTION

1. Field of the Invention

The present invention relates to a pumping system for liquid chemicals and the like.

2. Description of the Prior Art

Heretofore, the usual way to pump chemicals from a drum was to provide a pump resting on top of the drum or elsewhere and extend a suction pipe therefrom down into the drum through an open hole in the top thereof. With the use of an open system such as described above, and particularly with poisonous or hazardous chemicals or the like, a problem was created by the chemicals that drip from the suction pipe when withdrawn therefrom and the user otherwise coming in contact with such chemicals, as for example when the pump was cleaned. Also, many times the user of the pump would not clean the pump and certain chemicals caused clogging or rusting thereof necessitating the replacement with new parts or a new pump.

SUMMARY OF THE INVENTION

The present invention is directed toward providing an improved pumping system for liquid chemicals and the like in which the system is a closed or self-contained system so that the chemicals need not be touched by human hands. The concept of the present invention is to provide a pump which is an integral part of the container of the chemicals and to provide a detachable drive means for driving the pump. Thus, the drive means which is a more expensive part containing the motor can be removed and the inexpensive pump portion may be destroyed with the container so that safety to the personnel is achieved and the environment is protected.

The system of the present invention comprises, in general, a container having an interior for holding chemicals and the like, outlet means attached to the wall of the container in an opening, dispensing means for dispensing chemicals and the like from the outlet means, pump means attached to the wall in another opening for pumping chemicals and the like from the container interior to the outlet means, drive means for driving the pump means, and detachable means for detachably coupling the drive means to the pump means for the operation thereof.

One of the objects of the present invention is to provide a closed system in which the pump portion is inexpensive, made out of plastic, and therefore burnable under certain EPA requirements and there is no necessity for having to clean out the pump.

A further object is to provide such a system which is self-priming and top unloading.

A further object is to provide such a system which can pump flowable materials.

A further object is to provide such a system which has a reusable and detachable motor.

A further object is to provide in such a system a nonspillable drum.

DESCRIPTION OF THE PREFERRED EMBODIMENT

Figure 1:
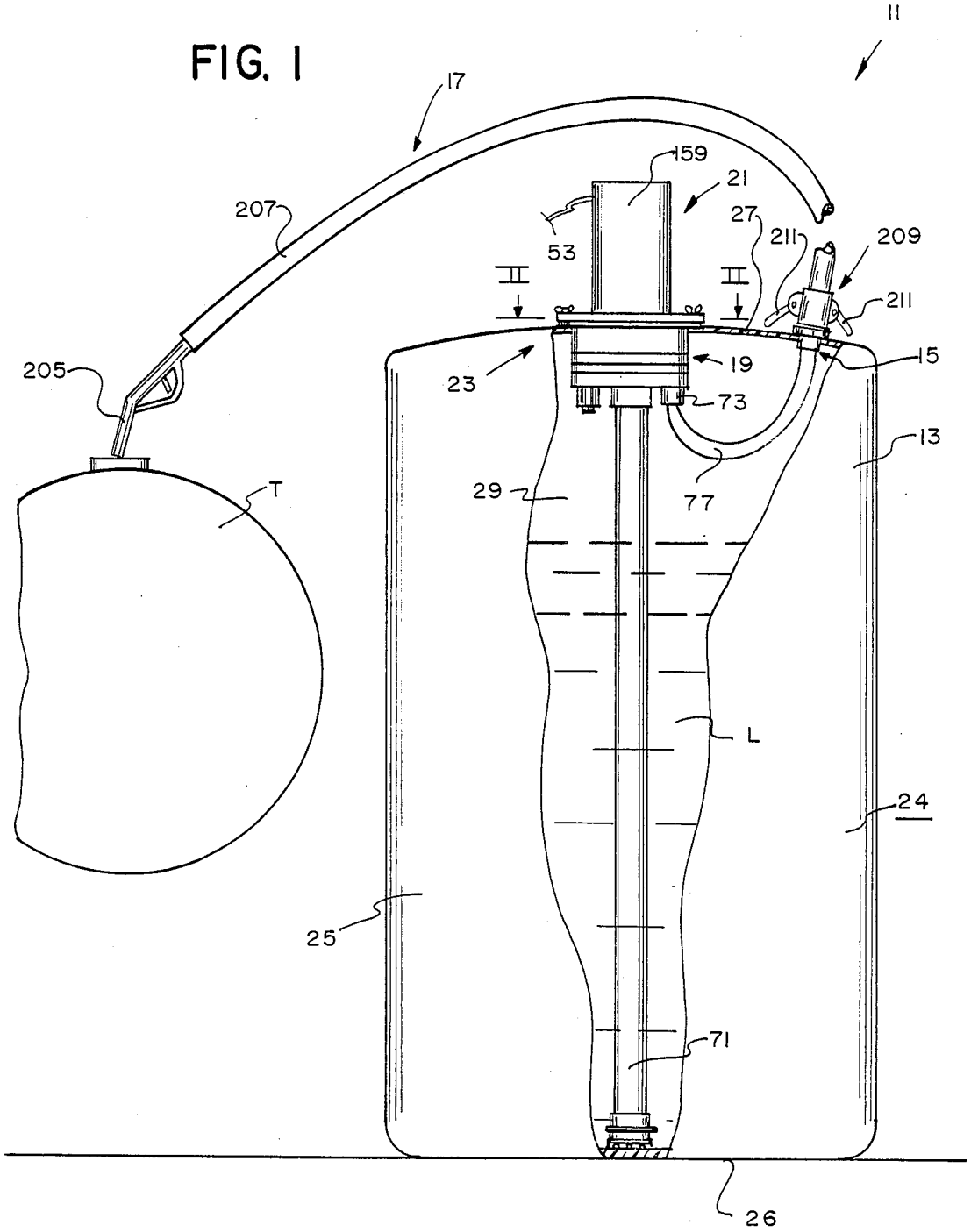
FIG. 1 is a side elevational view of the closed pumping system of the present invention with portions broken away for purposes of illustration.

The pumping system 11 of the present invention includes, in general, a container 13 for holding the liquid chemicals L or the like, outlet means 15, dispensing means 17, pump means 19, drive means 21, and detachable means 23 for detachably coupling drive means 21 to the pump means 19.

The container 13 is enclosed by a wall 24 including cylindrical side wall 25, a bottom wall 26 integrally attached to the lower edge of cylindrical wall 25, and a top wall 27 integrally attached to the upper edge of cylindrical wall 23. Wall 24 encloses and defines the interior 29 of the container 13 in which the liquid chemical L and the like is contained. The container 13 is preferably formed of plastic or the like whereby it may be disposed of as by burning under certain EPA requirements. Top wall 27 is provided with a first opening 31, preferably centrally thereof, and a second opening 33 spaced from opening 31.

Pump means 19 includes a pump body 35 preferably formed from a plastic that can be disposed of. Pump body 35 is generally cylindrical and includes an upper section 37 and a lower section 39. An upper plate 41, an intermediate plate 43, and lower plate 45 are sandwiched between upper section 37 and lower section 39. A flexible diaphragm 47 is sandwiched between upper plate 41 and intermediate plate 43. A first gasket-valve 49 is sandwiched between intermediate plate 43 and lower plate 45, and a second gasket-valve 51 is sandwiched between intermediate plate 43 and lower section 39. The outer peripheral portions of upper section 37, lower section 39, upper plate 41, intermediate plate 43, lower plate 45, diaphragm 47, first gasket-valve 49 and second gasket-valve 51 form a cylindrical side wall 53 of pump body 35. The parts of side wall 53 are held together by suitable means as bolts 55.

Figure 35:
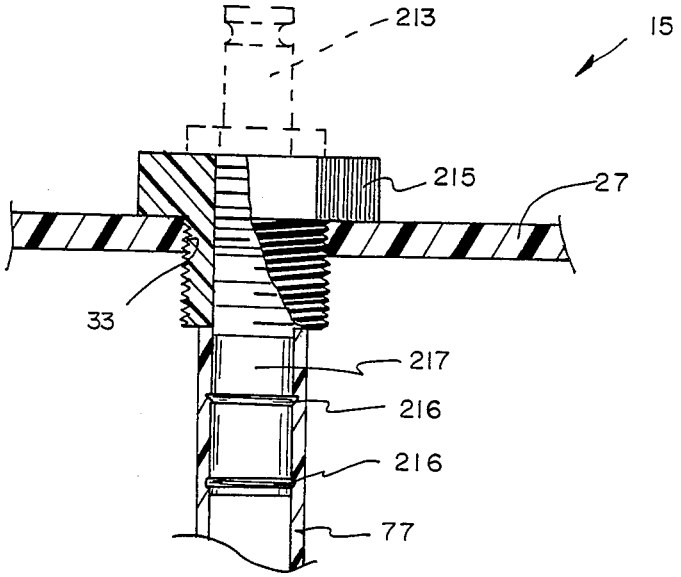
FIG. 35 is a partly sectionalized view of the outlet means of the present invention.
Figure 36:
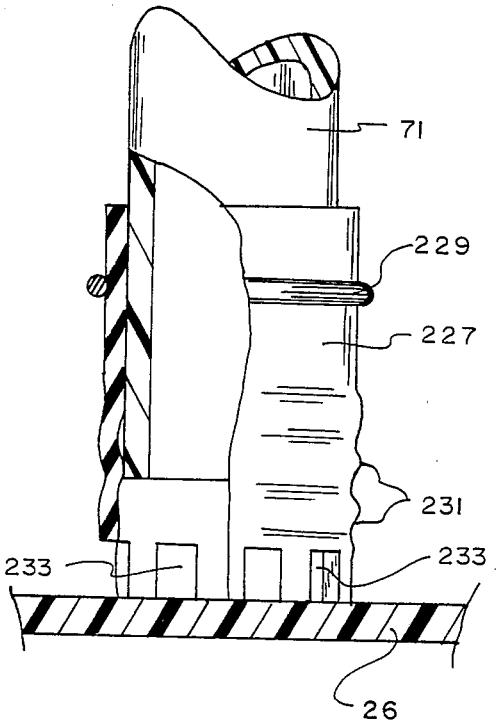
FIG. 36 is an enlarged view of the lower end portion of the inlet pipe that is shown in FIG. 1.
Figure 37:
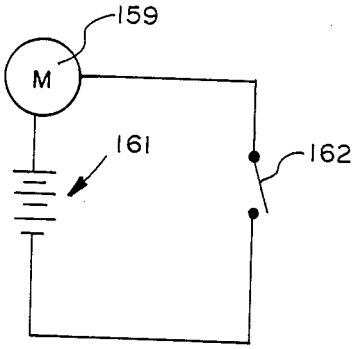
FIG. 37 is a schematic view of the electrical system of the present invention.

Lower section 39 includes an annular bottom 57, an annular side wall 59 integrally formed at the outer edges of bottom 57 and upstanding therefrom, an annular inner wall 61 integrally formed with bottom 57 and upstanding therefrom at a place spaced inwardly from side wall 59 to establish with lower plate 45 an inlet chamber 63 inwardly of inner wall 61 and to establish a concentric outlet chamber 65 outwardly of inner wall 61. Lower section 39 additionally includes a collar 67 integrally formed with bottom 57, depending centrally therefrom and establishing a socket 69 into which is fixedly mounted by suitable means an intake pipe 71 which is communicated with inlet chamber 63 at the upper end of pipe 71 and extends downwardly into the interior 29 of container 13 to a place adjacent but spaced from the bottom wall 26 to allow the liquid chemical L to flow into intake pipe 71 and into inlet chamber 63 when pump means 19 is operated, as will be better understood in the description to follow later in the specification. Lower section 39 also includes an additional collar 73 integrally formed with bottom 57 and depending therefrom to establish a socket 75 which receives one end of a discharge pipe 77. The other end of pipe 77 remote from collar 73 is coupled to outlet means 15 (see FIG. 35).

Figure 15:
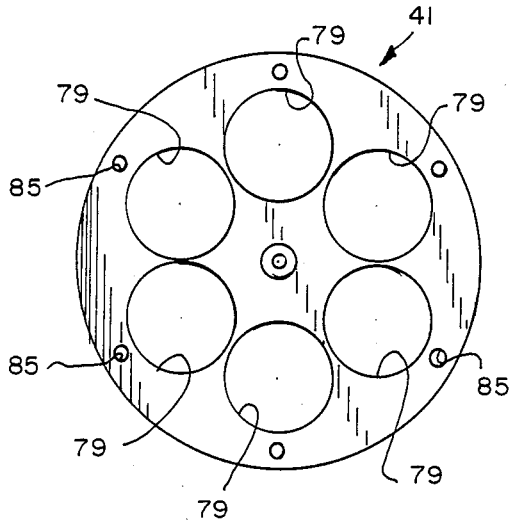
FIG. 15 is a top view of the upper plate of the pump of the present invention.
Figure 16:
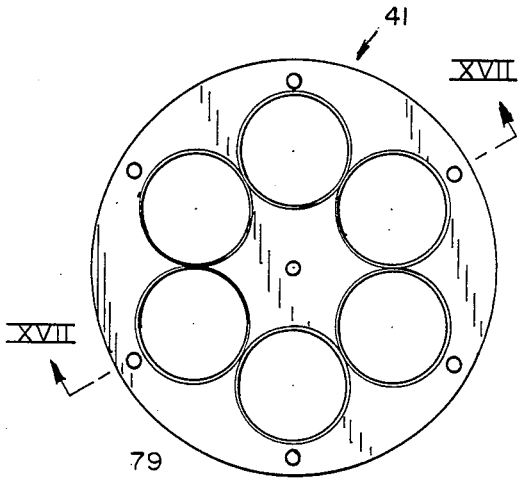
FIG. 16 is a bottom view of that shown in FIG. 15.
Figure 17:
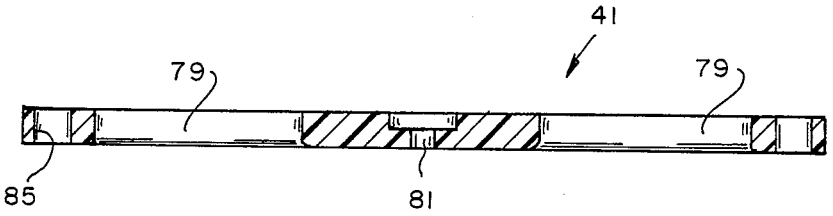
FIG. 17 is an enlarged sectional view taken as on line XVII—XVII of FIG. 16.
Figure 18:
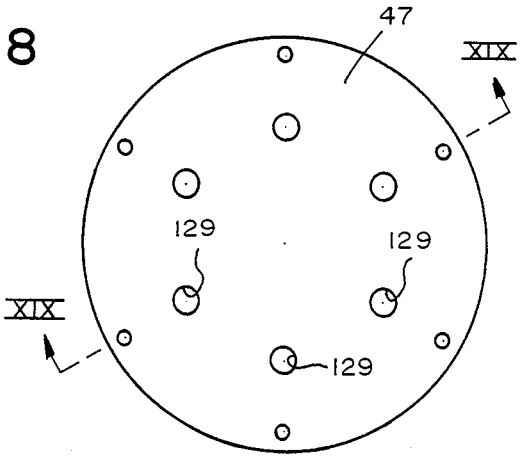
FIG. 18 is a top view of the diaphragm of the pump of the present invention.
Figure 19:
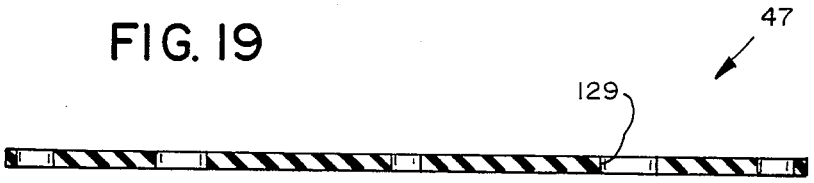
FIG. 19 is an enlarged sectional view taken as on line XIX—XIX of FIG. 18.

Upper plate 41 (see FIGS. 15–17) includes a plurality of circular openings 79 therethrough, which preferably are spaced evenly around the plate and are preferably, though not necessarily, six in number, with the number depending upon the volume desired for the pump means 19. Centrally of the plate 41 is an opening 81 through which extends bolt means 83 for clampingly holding together central portions of plates 41, 43, 45, diaphragm 47 and first gasket-valve 49. A plurality of holes 85 are disposed around plate 41 to receive bolt means 55.

Figure 20:
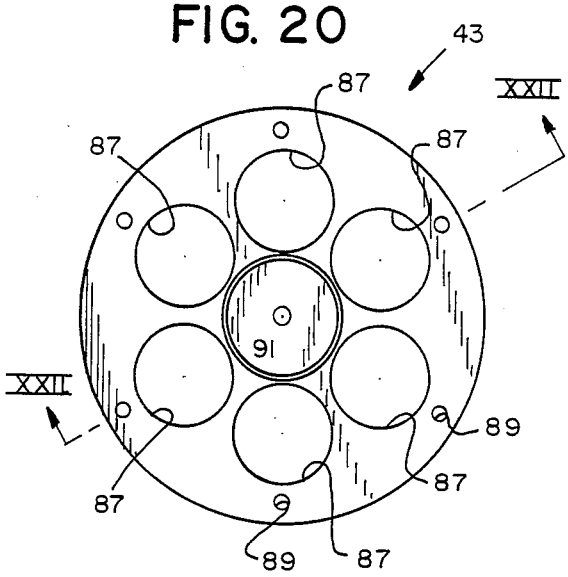
FIG. 20 is a top view of the bottom plate of the pump of the present invention.
Figure 21:
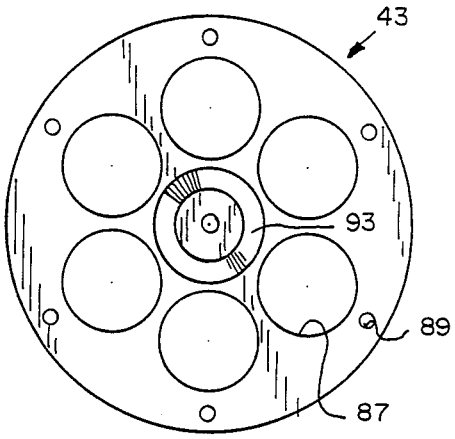
FIG. 21 is a bottom view of that shown in FIG. 20.
Figure 22:
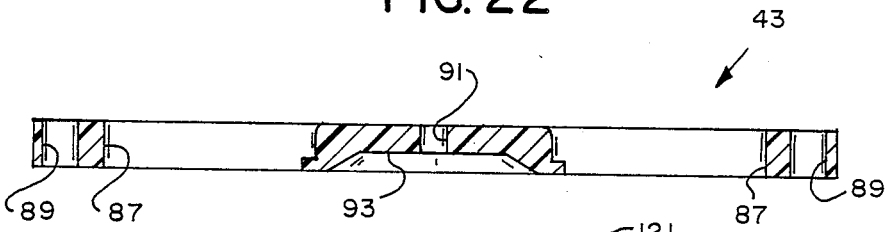
FIG. 22 is an enlarged sectional view taken as on the line XXII—XXII of FIG. 20.

Intermediate plate 43 (see FIGS. 20–22) includes a plurality of circular openings 87 of a like number and size as circular openings 79 and are disposed in alignment therewith. Similarly, intermediate plate 43 has a plurality of holes 89 through which bolt means 55 passes. Centrally of plate 43 is a hole 91 through which bolt means 83 passes. In addition, centrally of intermediate plate 43 on the lower side thereof is provided an inverted dish shaped seat 93 for receiving the central portion of gasket-valve 49.

Figure 4:
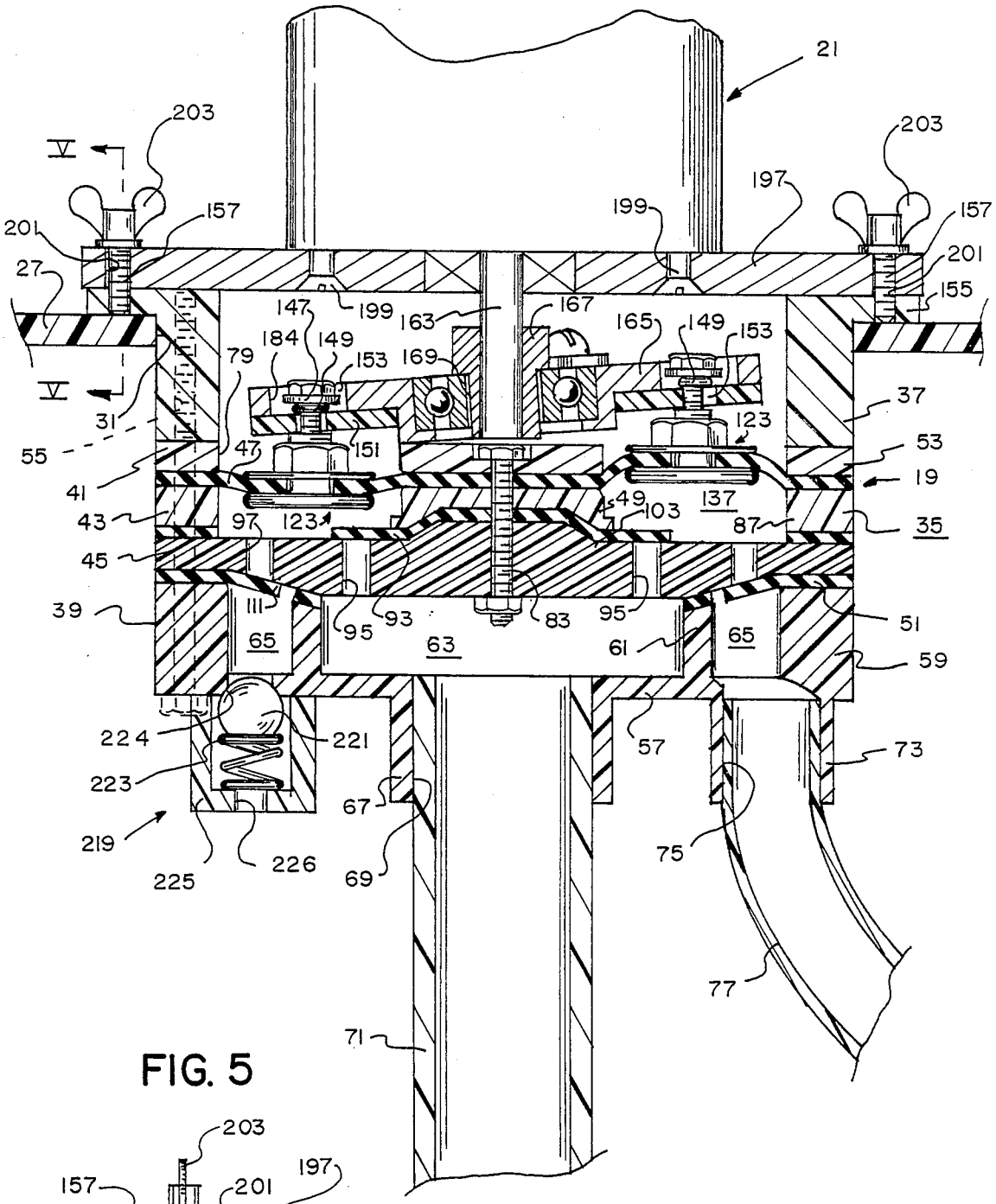
FIG. 4 is a sectional view taken as on line IV—IV of FIG. 2.
Figure 5:
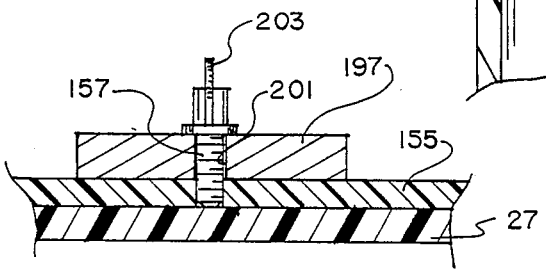
FIG. 5 is a fragmentary sectional view taken as on line V—V of FIG. 4.
Figure 6:
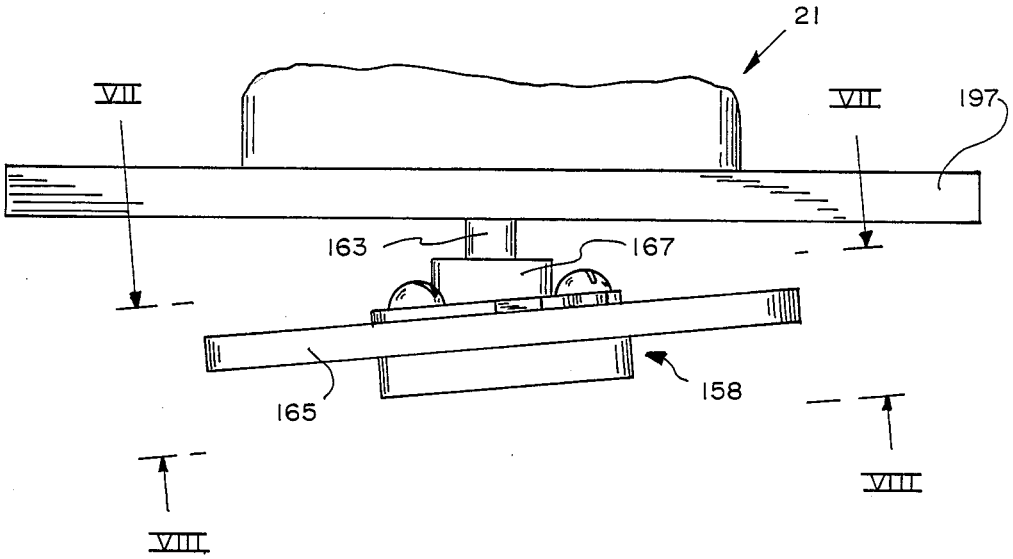
FIG. 6 is a side elevational view showing a portion of the detachable drive means of the present invention.
Figure 25:
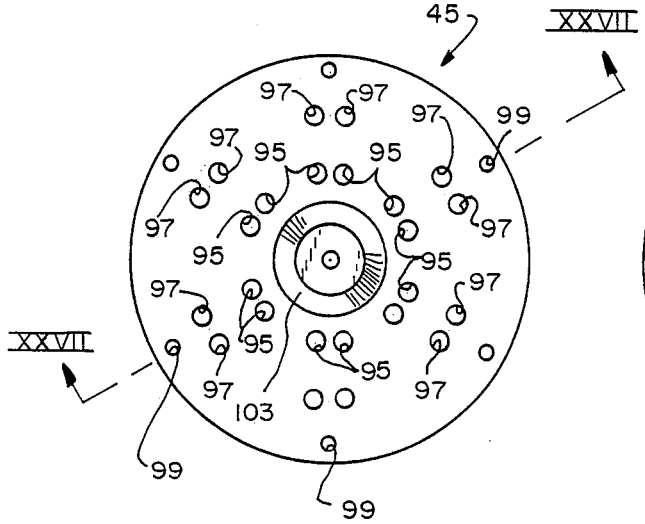
FIG. 25 is a top view of the lower plate of the pump of the present invention.
Figure 26:
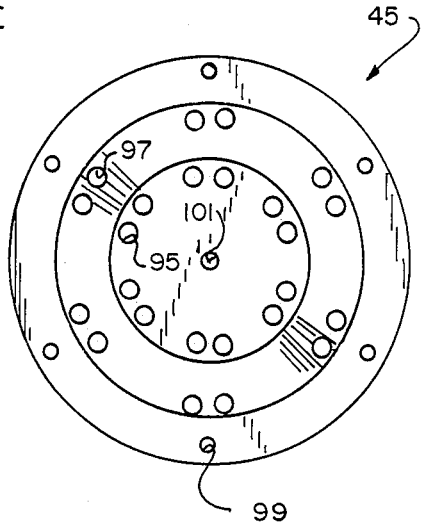
FIG. 26 is a bottom view of that shown in FIG. 25.
Figure 27:
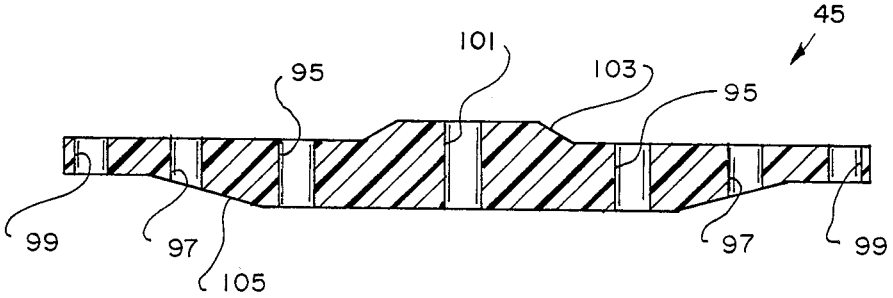
FIG. 27 is an enlarged sectional view taken as on the line XXVII—XXVII of FIG. 25.

Lower plate 45 (see FIGS. 25–27) includes an inner group of inlet apertures 95 therethrough and an outer group of outlet apertures 97 therethrough. Apertures 95 are preferably grouped together in six groups of two each as best seen in FIGS. 25 and 26 with the groups being respectively in alignment with openings 79 and 87. In addition, holes 99 are provided around the periphery of plate 45 to receive the bolt means 55. A central hole 101 is provided through plate 45 to receive the bolt means 83. The central portion 103 of plate 45 is raised and dish shaped to correspond with seat 93 of plate 43 for clamping the central portion of the gasket-valve 49 between the seat 93 and the central portion 103 as best seen in FIG. 4. The lower surface of lower plate 45 protrudes downwardly as at 105 in dish shaped fashion to hold the gasket valve 51 against a correspondingly dish shaped upwardly facing seat 107 in lower section 39.

Figure 28:
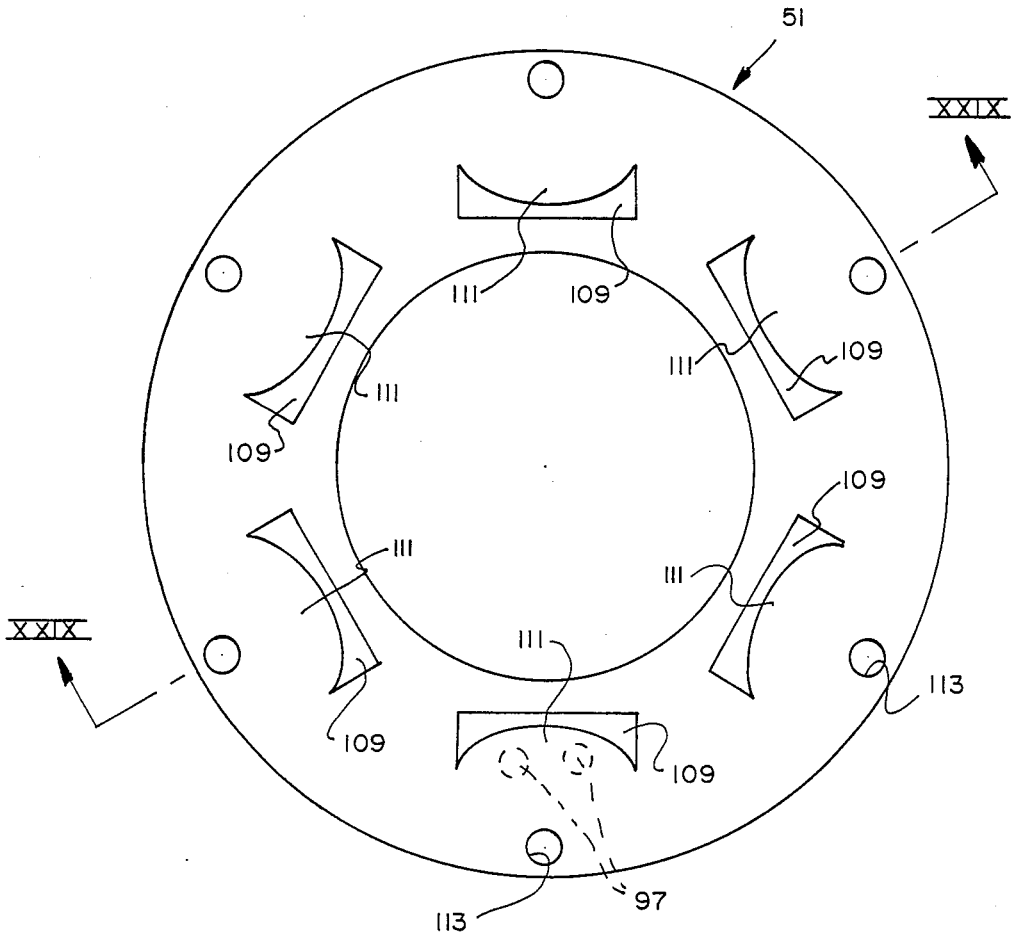
FIG. 28 is a top view of the second gasket valve means of the present invention, with a broken line diagrammatic showing of the relationship of the valve holes to a valve flap.
Figure 29:
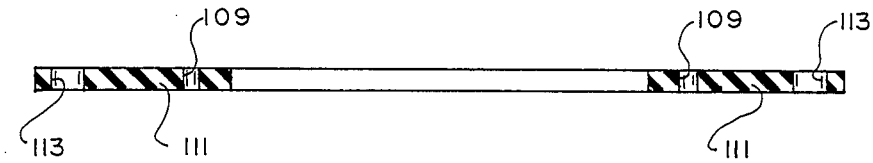
FIG. 29 is a sectional view taken as on the line XXIX—XXIX of FIG. 28.
Figure 30:
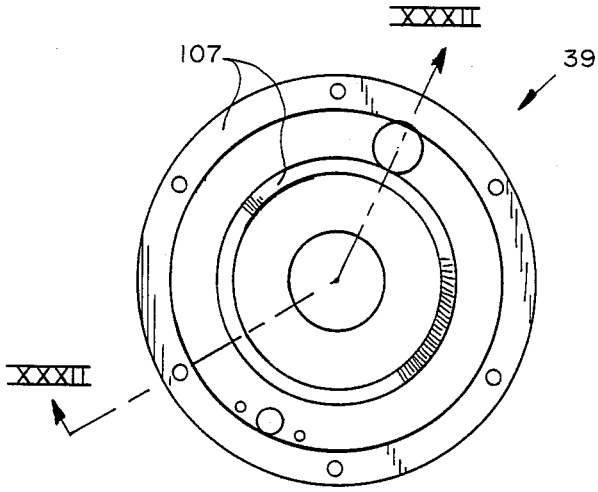
FIG. 30 is a top view of the lower section of the pump body of the present invention.
Figure 31:
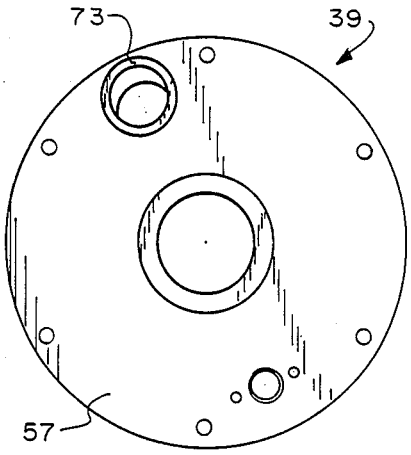
FIG. 31 is a bottom view of that shown in FIG. 30.
Figure 32:
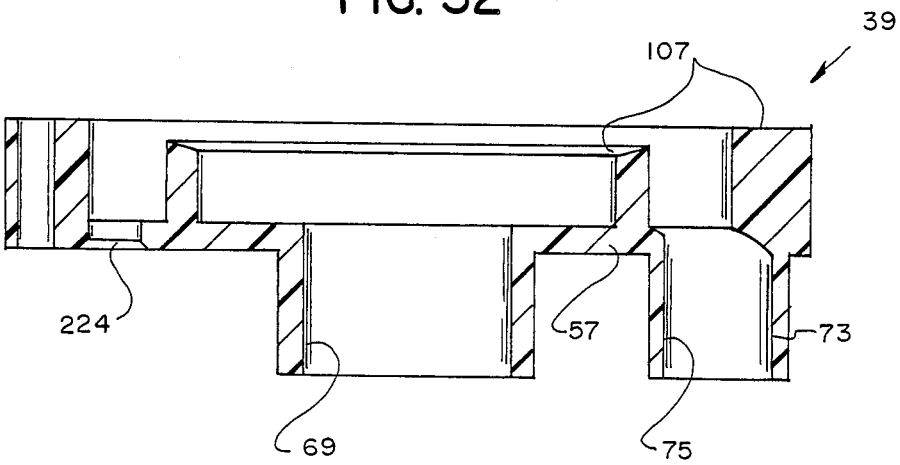
FIG. 32 is an enlarged sectional view taken as on the line XXXII—XXXII of FIG. 30.

Gasket valve 51 (see FIGS. 28 and 29) has a plurality of cut out portions 109 to establish the plurality of arcuately shaped valve flaps 111 corresponding to the six groups of apertures 97. The valve flaps 111 are positioned to underlie respectively the groups of apertures 97, as best seen in FIGS. 4 and 28. Thus, the valve flaps 111 normally close the apertures 97 to prevent the flow upwardly through the apertures from outlet chamber 65 but permit flow downwardly through the apertures into outlet chamber 65. There are a plurality of holes 113 around the periphery of the gasket-valve 51 through which bolt means 55 extends.

Figure 23:
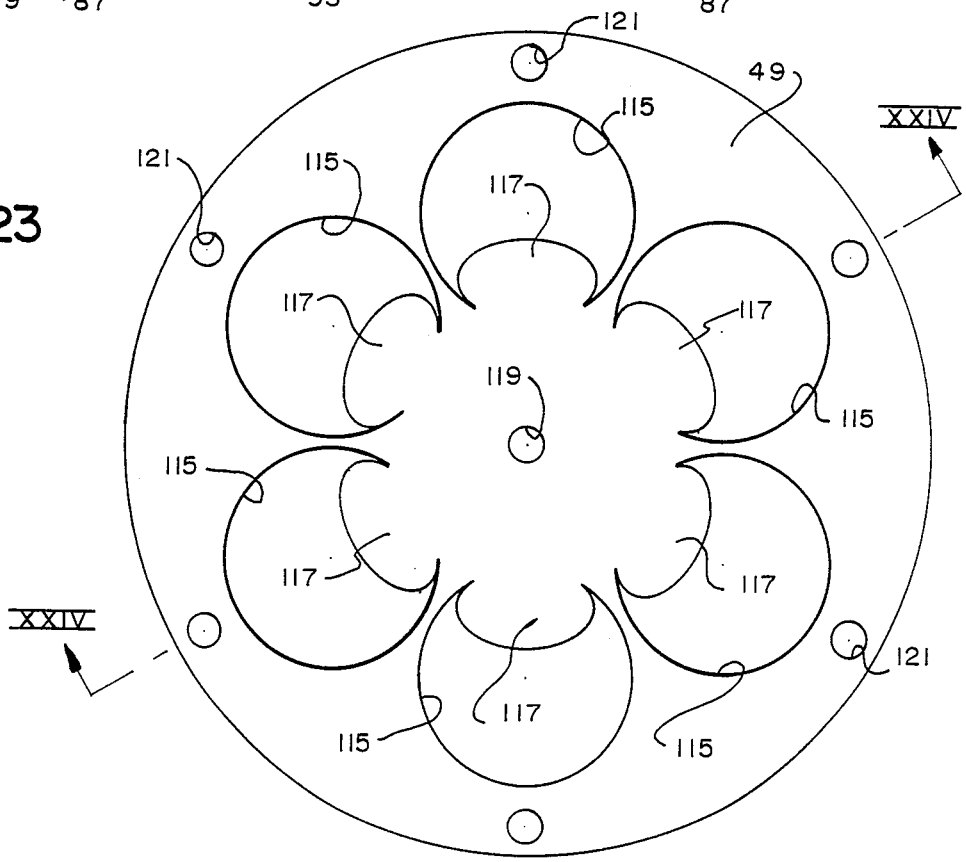
FIG. 23 is a top view of a first gasket valve means of the present invention.
Figure 24:
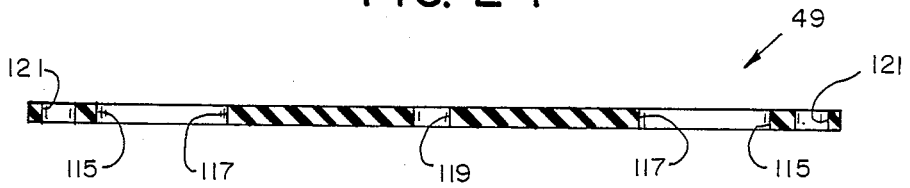
FIG. 24 is a sectional view taken as on line XXIV—XXIV of FIG. 23.

Gasket-valve 49 (see FIGS. 23 and 24) includes a plurality of cut out portions 115 to provide a plurality of valve flaps 117 which normally respectively extend over apertures 95 to respectively block off the apertures 95 to prevent flow of the liquid chemical downwardly through the apertures but permit flow through apertures 95 from inlet chamber 63. The cut outs 115 are arranged so that the gasket-valve 49 does not block the flow through the apertures 97. There is a central opening 119 through gasket-valve 49 through which bolt means 83 extends. There are a plurality of holes 121 around the periphery of the gasket-valve 49 through which bolt means 55 extends.

There are a plurality of piston means 123 respectively provided to operate through the aligned circular openings 79, 87. Thus, there are preferably six piston means 123 and the following description of one will suffice for all as they are substantially identical.

Figure 33:
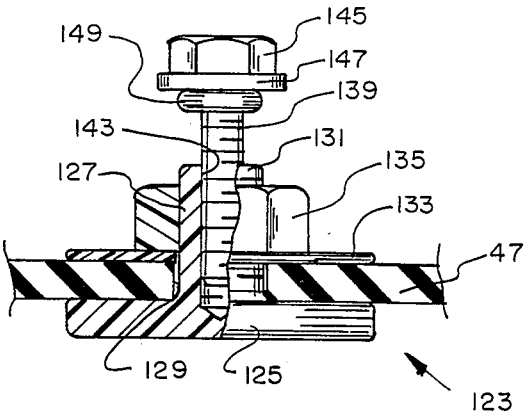
FIG. 33 is an enlarged view of the piston means portion of that shown in FIG. 4.

Piston means 123 (see FIG. 33) includes a circular head portion 125, a centrally disposed stud portion 127 integrally formed with head portion 125 and upstanding therefrom. Stud 127 extends upwardly through one of a plurality of apertures 129, in diaphragm 47, with piston head 125 extending below diaphragm 47. Stud 127 is threaded on the exterior thereof as at 131. A washer 133 is mounted over stud 127 above diaphragm 47 and the portions of the diaphragm around the aperture 129 are clamped by means of a nut 135 above the washer 133 engaging threading 131 so that there is a fluid tight joint to prevent liquid flowing through aperture 129.

A pump chamber 137 is provided beneath each of the piston means 123 which extends downwardly to lower plate 45. The chamber 137 is variable in size depending upon the position of the piston means 123. Thus, when a piston means 123 is in the upper position as shown by the one to the right in FIG. 4, the size or volume is at a maximum and when it is in a position shown to the left in FIG. 4, it is at a minimum. Each of the chambers 137 is thus defined by portions of diaphragm 47, head portion 125, portions of intermediate plate 43 which define circular openings 87, and portions of lower plate 45. A bolt 139 is threadedly engaged in a threaded socket 143 in the upper end of the stud 127. The head 145 of bolt 139 is provided with a flange 147 fixed thereto, and an O-ring 149 is provided around the shaft of bolt 139 adjacent the flange 147.

Each of piston means 123 is loosely attached to a sub-wobble plate 151 with bolt 139 extending through one of a plurality of holes 153 in sub-wobble plate with O-ring 149 and flange 147 being above sub-wobble plate 151 and stud 127 being therebelow as best seen in FIG. 4.

Upper section 37 of pump body 35 is provided with a peripheral flange 155. Pump body 35 is mounted in opening 31 of top wall 27 with the main portion of the pump body extending downwardly through the opening 31 and with flange 155 extending above portions of the top wall 27 adjacent opening 31, as best seen in FIG. 4. Flange 155 is fixedly and sealably attached to top wall 27 by suitable well-known means, not shown, in a manner well-known to those skilled in the art. Threaded studs 157 are fixedly attached to flange 155 by suitable means and upstand therefrom for purpose later to be described.

Drive means 21 includes actuating means 158 for actuating pump means 19 and includes motor means 159 for driving actuating means 158.

Motor means 159 is of any suitable construction such as an electric motor driven by a suitable power source as a battery 161. A suitable switch 162 is provided for turning motor means off and on. Motor means includes a rotatable shaft 163.

Actuating means 158 includes a wobble plate means 165 mounted on shaft 163. Wobble plate means 165 includes a hub 167 which has a cylindrical outer surface 169 which has its axis tilted relative to the axis of the central bore 171 of the hub 167. Hub 167 is fixedly mounted on shaft 163 by suitable means and has an inner race 173 of ball bearing means 175 fixedly attached thereto. The outer race 177 of ball bearing means 175 is fixedly attached to the plate per se 179 which is part of wobble plate means 165.

Figure 2:
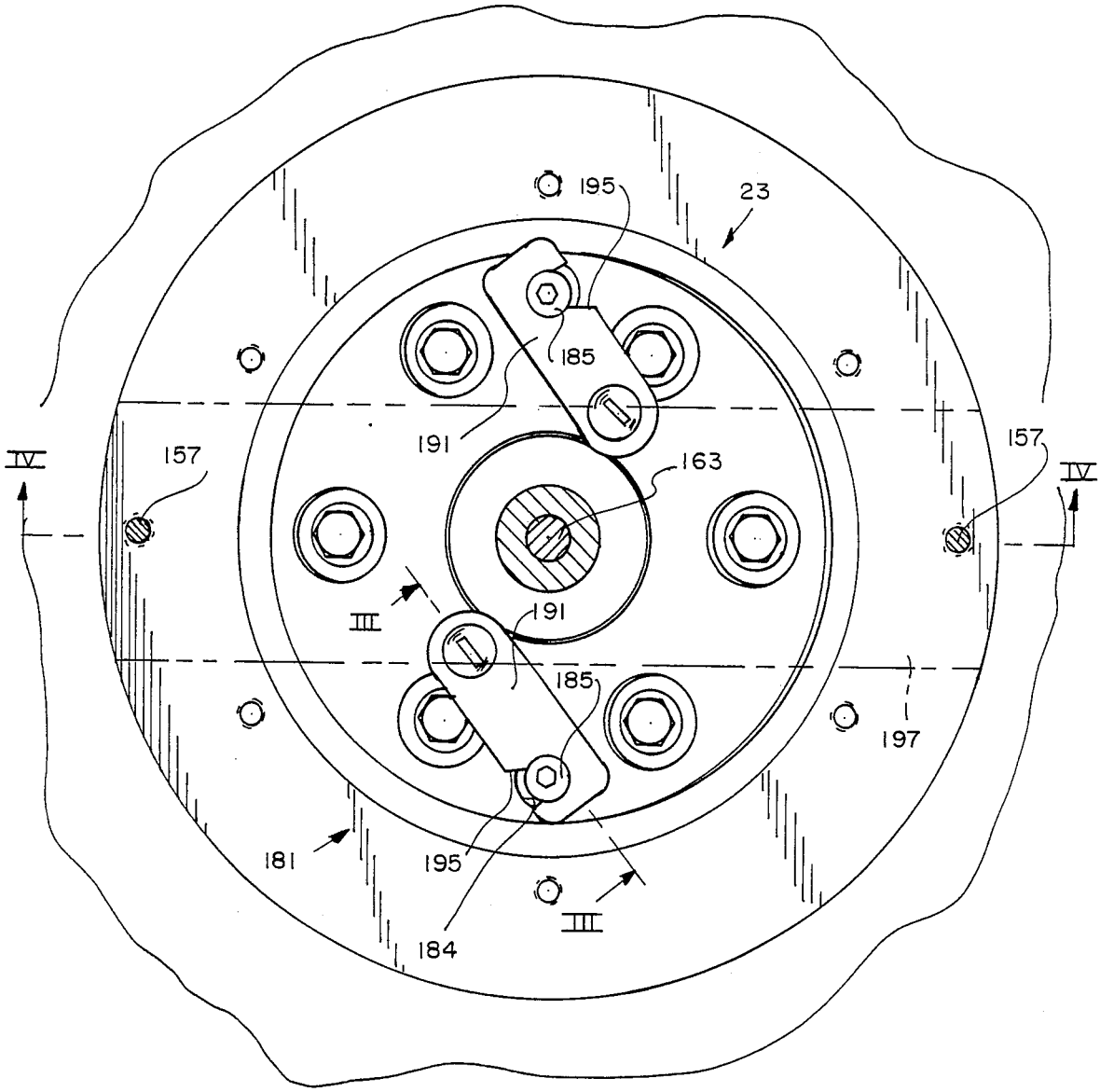
FIG. 2 is an enlarged fragmentary sectional view taken as on line II—II of FIG. 1.
Figure 3:
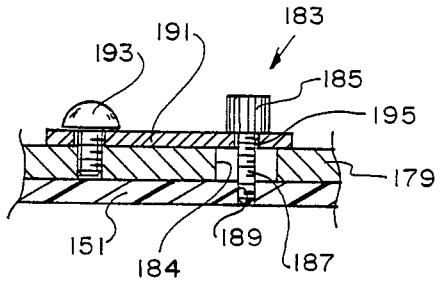
FIG. 3 is a fragmentary sectional view taken as on line III—III of FIG. 2.
Figure 7:
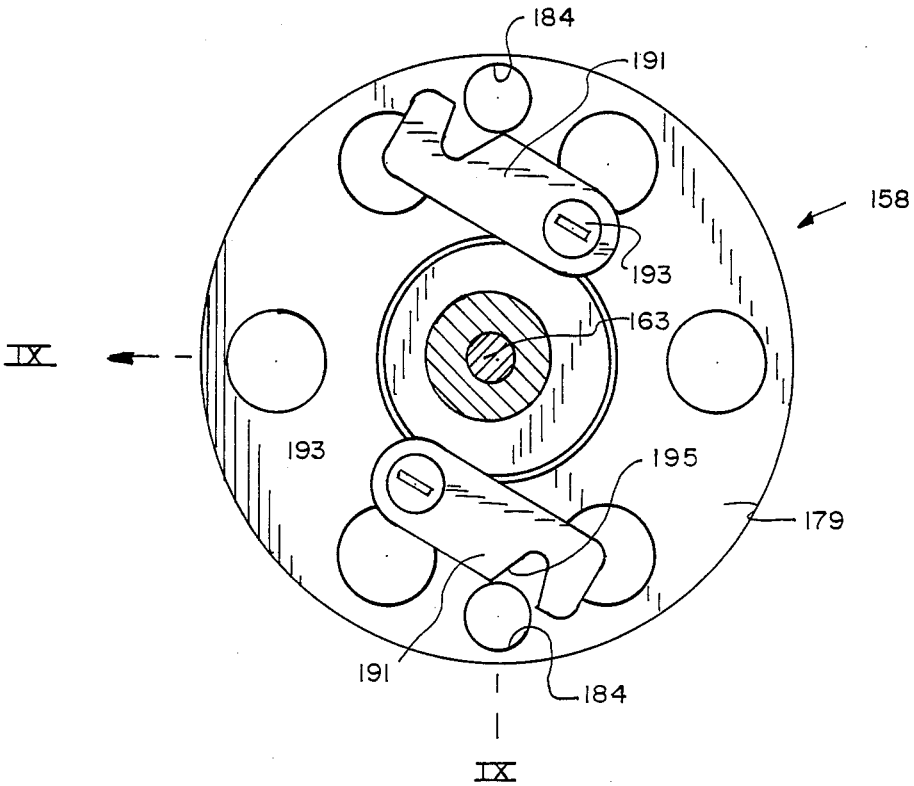
FIG. 7 is a sectional view taken as on the line VII—VII of FIG. 6.
Figure 8:
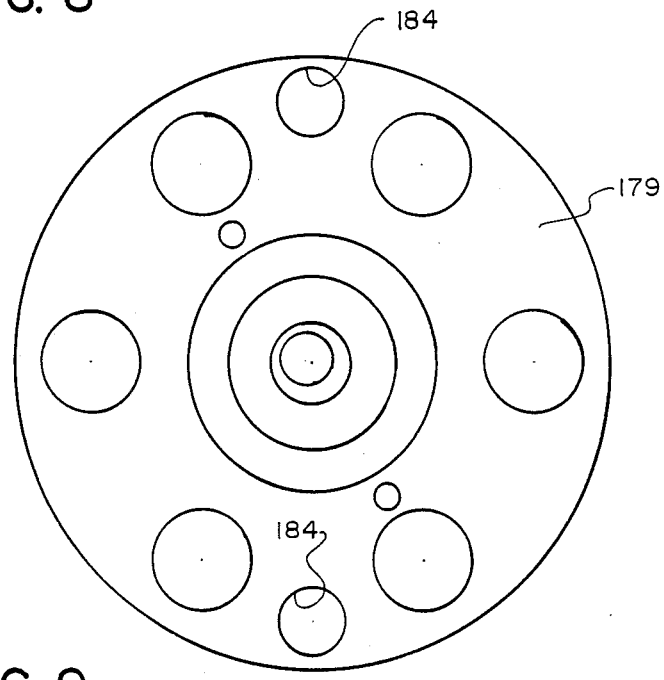
FIG. 8 is a bottom view of that shown in FIG. 7 and taken as on line VIII—VIII of FIG. 6 with portions removed for purposes of clarity.
Figure 9:
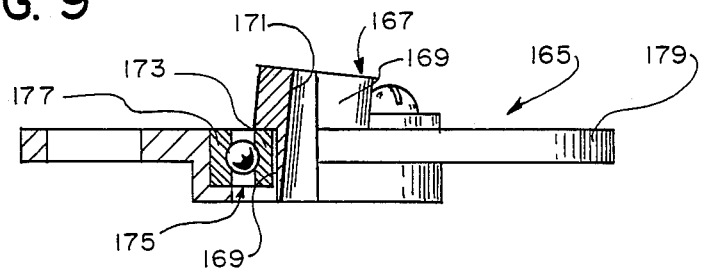
FIG. 9 is a side elevational view of a portion of that shown in FIG. 6 with portions thereof broken away for purposes of clarity.
Figure 10:
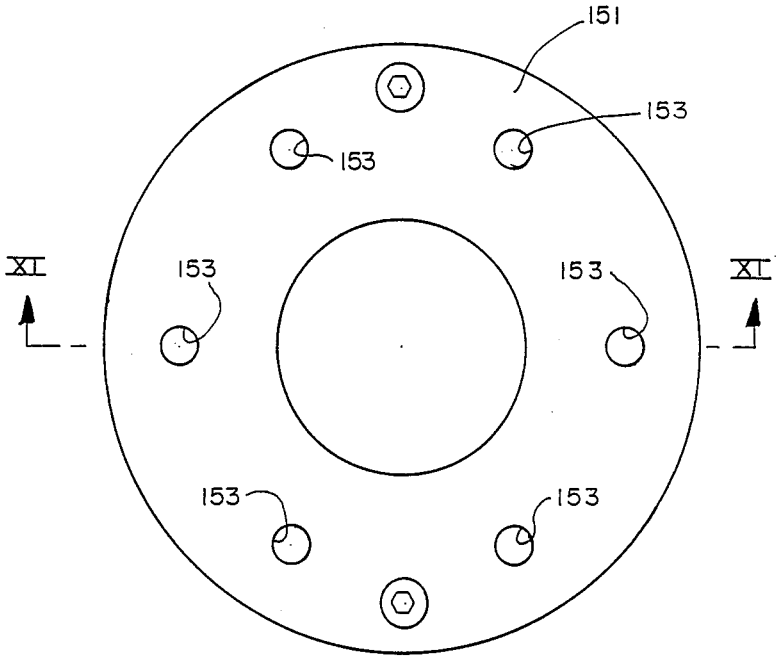
FIG. 10 is a top view of the sub-wobble plate.
Figure 11:
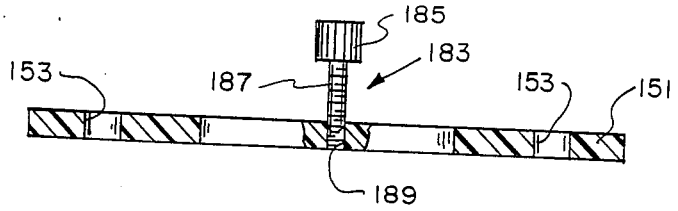
FIG. 11 is a sectional view taken as on the line XI—XI of FIG. 10, and with a portion broken away for purposes of clarity.
Figure 12:
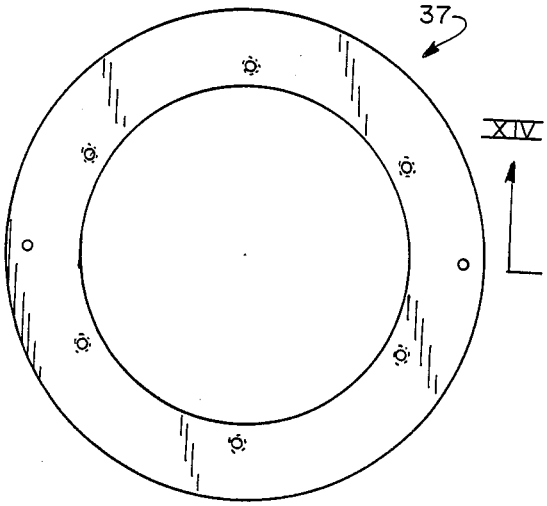
FIG. 12 is a top view of the upper section of the pump body of the present invention.
Figure 13:
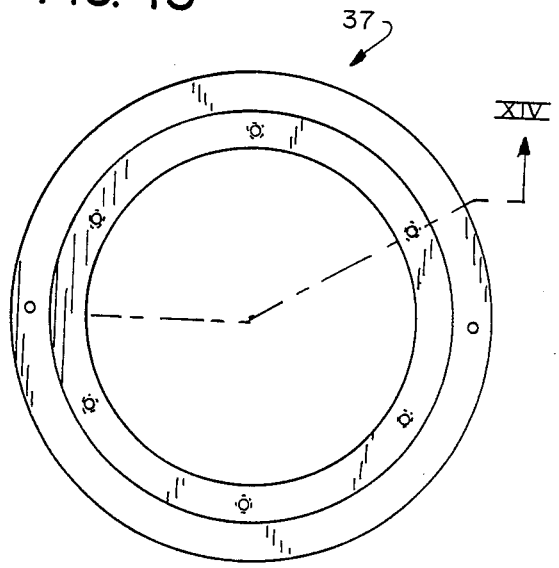
FIG. 13 is a bottom view of that shown in FIG. 12.
Figure 14:
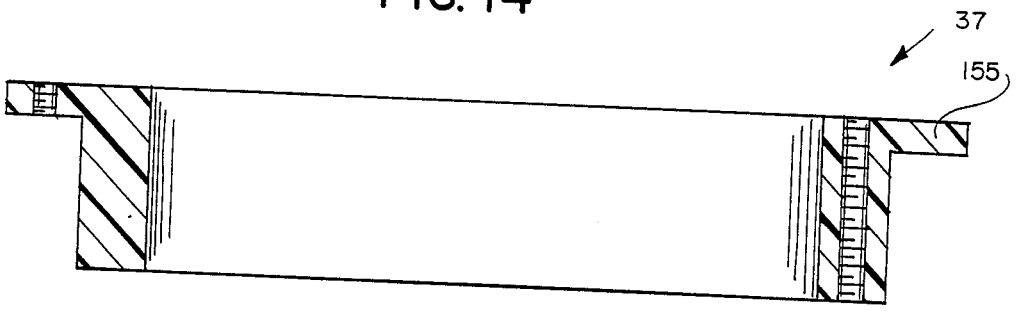
FIG. 14 is an enlarged sectional view taken as on the line XIV—XIV of FIG. 13.

Detachable means 181 for detachably coupling actuating means 158 to pump means 19 includes catch means in the form of a pair of catches 183 having a head portion 185 and a threaded shank portion 187 attached thereto. Shank portion 187 is threadedly attached to sub-wobble plate 151 as by being threaded into threaded aperture 189. Catches 183 respectively extend through holes 184 provided in plate 179 with the head 185 extending above the plate 179 for engagement by a latch means 191 which is swingably mounted on a pivot screw 193. Each latch means 191 has a notch 195 in the edge thereof so that the head portion 185 is engagable by latch means 191 with the shank portion 187 extending through the notch 195 to retain the wobble plate 179 in fixed engagement with sub-wobble plate 151 (see FIGS. 2 and 3). For disengagement of the wobble plate 179, the latch means 191 are swung away from catches 183 into the unlatched position shown in FIG. 7.

Motor means 159 is mounted on a cross member 197 by suitable means as screws 199. Cross member 197 is removably mounted on pump body 35 by placing cross member 197 across flange 155 with studs 157 extending upwardly through apertures 201 in opposite ends of cross member 197. Then, wing nuts 203 are threadedly mounted on shank portions 157 to hold the cross member 197 in place.

Dispensing means 17 includes a suitable nozzle means 205 of well-known construction attached to the end of a hose 207 by suitable well-known means and at the other end the hose is attached to outlet means 15 by suitable means, which is preferably a quick disconnect means 209 of well-known construction actuated by the levers 211 to attach and detach the dispensing means 17 to the outlet means 15. The outlet means 15 preferably includes a suitable male fitting 213 of a construction well-known to those skilled in the art which is adapted to mate with quick disconnect 209. Fitting 213 is threadedly received in a collar 215 to which is fixedly attached the end of pipe 77 by suitable well-known means as a pipe section 217 screwed into the threaded interior of collar 15 and having ribs 216 to frictionally retain pipe 77. A suitable well-known clamp, not shown, if desired may be secured around pipe 77 to secure pipe 77 onto pipe section 217.

Pump body 35 is preferably provided with a dumping valve 219 which includes a ball 221 and spring 223 disposed in a short pipe section 225 extending from outlet chamber 65 to the interior of container 13. Spring 223 normally holds ball 221 against seat 224 in a closed position. When the pump means 19 is running and the pressure in outlet chamber 65 exceeds a given amount, as for example when the nozzle means 205 is cut off with the pump running, then the liquid chemical in the outlet chamber 65 is bypassed or dumped back into the container 13 through opening 226 in the end of pipe section 225.

The lower end of pipe 71 is preferably provided with a flexible skirt 227, which is held onto the lower end of pipe 71 by suitable means as a ring 229. The skirt 227 is formed with accordianlike undulations 231 and extends below the lower end of pipe 71 into contact with bottom wall 26. A plurality of notches 233 are provided in the lower edge of skirt 227 to permit the liquid chemicals to flow into pipe 71. It will be understood that the above-described construction of skirt 227 insures that the skirt is in contact with the bottom wall 26, even with variations in the depth of interior 29 of containers 13, so that substantially all of the liquid chemical can be dispensed from container 13. It is contemplated that the user of the pumping system 11 will probably own a drive means 21 and dispensing means 17 and will receive a container 13 which has the pump means 19 integrally attached thereto but without any drive means 21 or dispensing means 17. Thus, in this way the user can utilize his own drive means 21 and dispensing means 17 without having to buy the complete pumping system 11 each time he buys a container 13 full of liquid chemicals.

Figure 34:
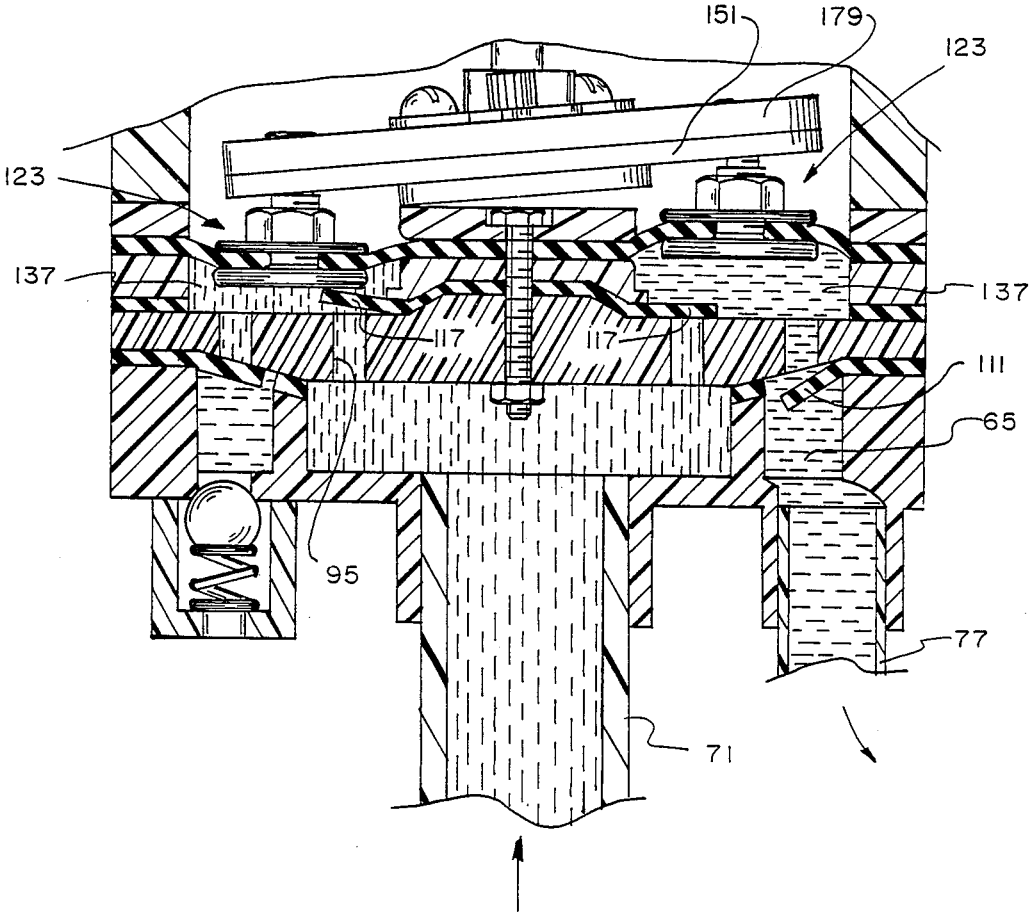
FIG. 34 is a partly sectionalized view showing the operation of the pump means of the present invention.

When the user receives the container 13 it will be in the above-mentioned condition and will have a suitable plug or cap, not shown, over the outlet means 15, which is then removed and the dispensing means 17 attached thereto with the quick disconnect 209 or other suitable means. Next, to prepare for the operation of pumping system 11 the user connects drive means 21 to pump means 19 in the following manner: Cross member 197 is placed on the flange 155 of pump body 35 with stud means 157 extending upwardly through apertures 201. Then, he places wing nuts 203 on the threaded studs 157. Then, he latches latch means 191 into engagement with the catches 183 to fixedly attach the wobble plate 179 to sub-wobble plate 151. The motor means 159 is then turned on by closing the switch 162 which causes the wobble plate 179 to wobble and cause upward and downward movement of the piston means 123. This in turn causes the liquid chemical to be drawn up through the intake pipe 71 into the inlet chamber 63 due to the pumping action of the piston means 123. It will be understood that when a piston means 123 moves upwardly, it will cause a suction action to pull the liquid chemical through intake pipe 71, through apertures 95, whereupon it lifts valve flap 117 so that the liquid passes into chamber 137. This action is shown in FIG. 34 where it will be seen that the piston means 123 to the left is in the beginning of its upward movement drawing liquid into chamber 137. Then downward movement of the piston means 123 causes pressure in chamber 137 to close the valve flap 117 and open valve flap 111 to move the liquid chemical into the outlet chamber 65 and pipe 77. This action is shown in FIG. 34 where it will be seen that the piston means 123 to the right is in the beginning of its downward movement forcing liquid from chamber 137.

From pipe 77 the liquid is forced through outlet means 15 and dispensing means 17 into the desired place as the tank T shown in FIG. 1.

After the container 13 is empty, the user may then remove the drive means 21 and dispensing means 17. Then, the container 13 with the integral pump means 19 may be disposed of as by burning since all of the parts are plastic or otherwise disposable.

From the foregoing it will be understood that system 11 provides a closed system in that the opening 31 is at all times blocked off to prevent liquid chemicals from exiting therethrough. Thus, blocking means is provided by diaphragm 47 to prevent contact of the chemicals by human hands during the entire operation of attaching and detaching drive means 21, dispensing of the liquid chemicals, disposing of the container 13, etc.

Although the present invention has been described and illustrated with respect to a preferred embodiment thereof and a preferred use therefore, it is not to be so limited since changes and modifications can be made therein which are within the full intended scope of the invention.

I claim:

1. A closed pumping system for liquid chemicals and the like comprising:

(a) a container having an interior for holding chemicals and the like, said container including a wall defining said interior and having a first opening and a second opening therethrough;

(b) outlet means attached to said wall in said second opening;

(c) dispensing means for dispensing chemicals and the like from said outlet means;

(d) pump means integrally attached to said wall in said first opening for pumping chemicals and the like from said container into said outlet means, said pump means being integrally attached to said wall in said first opening to form an integral part of said container;

(e) drive means for driving said pump means; and (f) detachable means for detachably coupling said drive means to said pump means from the outside of said container for the operation thereof and for the subsequent removal of said drive means from said pump means leaving said pumping system in a closed condition with said pump means and said container intact.

2. The closed pumping system of claim 1 in which said pump means includes blocking means for blocking off said first opening when said drive means is removed from said pump means as well as when said drive means is coupled to said pump means to prevent chemicals and the like from exiting therethrough.

3. The closed pumping system of claim 2 in which said blocking means comprises a flexible diaphragm, said pump means includes body means, a plurality of piston means attached to said diaphragm, a lower plate spaced below said diaphragm to establish with said body means a pump chamber beneath each of said piston means between said diaphragm and said lower plate, an inlet chamber and an outlet chamber below said lower plate, said lower plate being provided with a first set of inlet apertures communicating each said pump chamber with said inlet chamber and a second set of outlet apertures communicating each said pump chamber with said outlet chamber, a discharge pipe extending between said outlet chamber and said outlet means, and an intake pipe extending from adjacent the bottom interior of said container to said inlet chamber, flexible first gasket-valve means for closing and opening said first set of inlet apertures to permit the intake of chemicals and the like from said inlet chamber to each said pump chamber, flexible second gasket-valve means for closing and opening said second set of outlet apertures to permit the outflow of chemicals and the like each said first pump chamber to said outlet chamber.

4. The closed pumping system of claim 3 in which said container wall includes a bottom wall, a skirt attached to said intake pipe at the lower end thereof and extending into contact with said bottom wall, said skirt being flexible and having undulations therein to accommodate variations in the depth of the interior of said container, and said skirt being provided with notches in the lower edge thereof for permitting liquid to flow from the interior of said container into said intake pipe.

5. The closed pumping system of claim 1 in which said dispensing means includes a nozzle, a first conduit connected to said nozzle and quick release means fixedly attached to said first conduit remote from said nozzle and releasably connected to said outlet means.

6. The closed pumping system of claim 1 in which said container is an integral one piece container.

7. A closed pumping system for liquid chemicals and the like comprising:

(a) a container having an interior for holding chemicals and the like, said container including a wall defining said interior and having a first opening and a second opening therethrough;

(b) outlet means attached to said wall in said second opening;

(c) dispensing means for dispensing chemicals and the like from said outlet means;

(d) pump means integrally attached to said wall in said first opening for pumping chemicals and the like from said container into said outlet means, said pump means including blocking means for blocking off said first opening to prevent chemicals and the like from exiting therethrough, said blocking means comprising a flexible diaphragm, said pump means including body means, a plurality of piston means attached to said diaphragm, a lower plate spaced below said diaphragm to establish with said body means a pump chamber beneath each of said piston means between said diaphragm and said lower plate, an inlet chamber and an outlet chamber below said lower plate, said lower plate being provided with a first set of inlet apertures communicating each said pump chamber with said inlet chamber and a second set of outlet apertures communicating each said pump chamber with said outlet chamber, a discharge pipe extending between said outlet chamber and said outlet means, and an intake pipe extending from adjacent the bottom interior of said container to said inlet chamber, flexible first gasket-valve means for closing and opening said first set of inlet apertures to permit the intake of chemicals and the like from said inlet chamber to each said pump chamber, flexible second gasket-valve means for closing and opening said second set of outlet apertures to permit the outflow of chemicals and the like from each said pump chamber to said outlet chamber;

(e) drive means for driving said pump means, said drive means including actuating means for actuating said pump means and motor means for driving said actuating means, said motor means including a shaft, said actuating means including wobble plate means mounted at an angle on said shaft, said pump means including sub-wobble plate means attached to said piston means; and (f) detachable means for detachably coupling said drive means to said pump means for the operation thereof said detachable means including catch means attached to said sub-wobble plate means extending upwardly therefrom and latch means movably mounted on said wobble plate means for movement into and out of engagement with said catch means for the latching and unlatching of said wobble plate means to said sub-wobble plate means.

8. The closed pumping system of claim 7 which includes a cross member attached to said motor means and attachment means for detachably coupling said cross member to said pump means.

9. A closed pumping system for liquid chemicals and the like comprising:

(a) a disposable container comprising a wall enclosing and defining the interior of said container and including a continuous side wall having an upper edge and a lower edge, a top wall integrally attached to said upper edge of said side wall, and a bottom wall integrally attached to said lower edge of said side wall, said top wall having a first opening and a second opening therethrough;

(b) outlet means attached to said wall in said second opening;

(c) dispensing means for dispensing chemicals and the like from said outlet means;

(d) pump means for pumping chemicals and the like from said container into said outlet means, said pump means being disposable and being integrally attached to said top wall in said first opening to form an integral part of said container whereby said pump means is adapted to be disposed of with said container;

(e) drive means for driving said pump means; and (f) detachable means for detachably coupling said drive means to said pump means from the outside of said container for the operation thereof and for the subsequent removal of said drive means from said pump means leaving said pumping system in a closed condition with said pump means and said container intact for the disposal of said pump means and said container.

10. The closed pumping system of claim 9 in which said pump means includes blocking means for blocking off said first opening when said drive means is removed from said pump means as well as when said drive means is coupled to said pump means to prevent chemicals and the like from exiting therethrough, said blocking means comprising a flexible diaphragm, said pump means including body means, a plurality of piston means attached to said diaphragm, a lower plate spaced below said diaphragm to establish with said body means a pump chamber beneath each of said piston means between said diaphragm and said lower plate, an inlet chamber and an outlet chamber below said lower plate, said lower plate being provided with a first set of inlet apertures communicating each said pump chamber with said inlet chamber and a second set of outlet apertures communicating each said pump chamber with said outlet chamber, a discharge pipe extending between said outlet chamber and said outlet means, and an intake pipe extending from adjacent the bottom interior of said container to said inlet chamber, first valve means for closing and opening said first set of inlet apertures to permit the intake of chemicals and the like from said inlet chamber to each said pump chamber, second valve means for closing and opening said second set of outlet apertures to permit the outflow of chemicals and the like from each said pump chamber to said outlet chamber.

11. The closed pumping system of claim 10 in which said drive means includes actuating means for actuating said pump means and motor means for driving said actuating means, said motor means includes a shaft, said actuating means includes wobble plate means mounted at an angle on said shaft, and means for loosely attaching said piston means to said wobble plate means.

* * * * *